United States Patent [19]

Canino

[11] Patent Number: 4,890,387

[45] Date of Patent: Jan. 2, 1990

[54] DRYWALL UTILITY KNIFE

[76] Inventor: Serafino S. Canino, 94 Roosevelt Ave., Torrington, Conn. 06790

[21] Appl. No.: 321,791

[22] Filed: Mar. 10, 1989

[51] Int. Cl.[4] ..... B26B 11/00

[52] U.S. Cl. ..... 7/118; 30/162

[58] Field of Search ..... 30/162, 163, 335, 336, 30/160, 161, 128, 118.12 D, 15 D

[56] References Cited

U.S. PATENT DOCUMENTS

| | | | |
|---|---|---|---|
| 2,980,996 | 4/1961 | Beran | 7/118 |
| 3,061,927 | 11/1962 | von Frankenberg et al. | 7/118 |
| 3,660,896 | 5/1972 | Umholtz | 30/162 |

*Primary Examiner*—Douglas D. Watts

*Attorney, Agent, or Firm*—Leon Gilden

[57] ABSTRACT

A drywall utility knife is set forth including a main housing provided with an elongate slot positioned in a parallel relationship between the opposed parallel sides of the main housing. A removable knife housing is frictionally retained relative to the main housing and is provided with a biasing member to bias a utility knife against an interior wall of the housing to maintain the knife at a desired orientation relative to the housing. A pivotally mounted saw is oriented from a first position within the housing to a second position exteriorly of the housing and aligned lengthwise thereof formed with a resilient detent lock engageable with a rear blunt surface of the knife that is displaceable relative to the blunt surface to enable repositioning of the knife to the first position. A rasp surface is formed on a bottom surface of the knife for abrading drywall once severed or sawed by the blades of the knife. The knife is formed with a downwardly tapering forward side with an arcuate rear side to enable secure grasping of the knife within the palm of an individual's hand.

10 Claims, 1 Drawing Sheet

DRYWALL UTILITY KNIFE

BACKGROUND OF THE INVENTION

1. Field of the Invention

The field of invention relates to utility knives, and more particularly pertains to a new and improved drywall utility knife particularly arranged for the severing and preparation of drywall or sheet-rock.

2. Description of the Prior Art

Utility knives of various types have been utilized in the prior art for a variety of unique applications. In the housing industry, drywall or sheet-rock that is provided in four foot by eight foot planar sheets of varying thicknesses is frequently cut and sawed to a desired configuration to accommodate a particular geometric configuration within a housing wall. The instant invention overcomes the deficiencies of the prior art by setting forth a utility knife particularly adapted for use in the preparation of drywall that enables the drywall to be cut or alternatively sawed to a desired geometric configuration, and further providing an abrading rasp surface for the texturing of the drywall edges once cut or sawed to a desired configuration. Examples of prior art utility knives may be found in U. S. Pat. No. 1,388,014 to Aiguier setting forth a combined knife and saw wherein a saw blade is fixed in an aligned orientation relative to an underlying knife edge. The patent is of interest relative to the combination of a saw and knife edge, but is of a relatively remote organization to the compact and particularly arranged drywall utility knife of the instant invention.

U. S. Pat. No. 1,390,400 to Threet sets forth a combination knife and saw wherein a single blade includes a knife edge at a lowermost edge with a saw at the opposed upper elongate edge and is further provided with an additional utility can-type opener pivotally mounted within the handle of the blade. The Threet patent is of interest relative to the combination tool set forth.

U. S. Pat. No. 1,507,526 to Straub sets forth a combination cutting implement utilizing a single body formed with a medial reinforcing rib and an underlying saw blade and an opposed elongate cutting blade spaced at opposite terminal ends of the support body.

U. S. Pat. No. 4,461,081 to Gaskins sets forth a knife including a blade sandwiched between the knife and extending longitudinally thereof with a hollow sleeve securable over the blade including a saw tooth edge facing one edge of the blade so the item to be sawed can be positioned in the captured angle between the knife blade and the saw blade and be sawed through by oscillation of the knife handle.

U. S. Pat. No. 4,635,309 to Larsen sets forth a multiple use hand tool utilizing an elongate handle having a longitudinal elongate bore therethrough slidably mounting a utility knife at one end and a marking member at the other end. The Larsen patent is of interest relative to the multiple use tool positioned within a single hollow body.

As such, it may be appreciated that there is a continuing need for a new and improved drywall utility knife which addresses the unique problems associated with the fastening and configuring of drywall to an associated support wall surface and in this respect, the instant invention substantially fulfills this need.

SUMMARY OF THE INVENTION

In view of the foregoing disadvantages inherent in the known types of utility knives now present in the prior art, the present invention provides a utility knife wherein the same sets forth a housing including a pivotally mounted saw blade, a telescopingly mounted utility knife, and rasp formed to an external elongate surface of the knife to enable the proper configuring and texturing of drywall or sheet rock in the housing trade. As such, the general purpose of the present invention, which will be described subsequently in greater detail, is to provide a new and improved drywall utility knife which has all the advantages of the prior art utility knives and none of the disadvantages.

To attain this, the present invention the present invention comprises a utility knife including a pivotally mounted saw blade and a telescopingly mounted utility knife which may be compactly stored during periods of non-use. A rasp surface formed to a lowermost surface of the main housing body enables texturing of drywall in preparation of the interfitting of such drywall pieces together. A biasing member orients the utility knife in a predetermined positioning relative to the housing wherein the saw blade is provided with a spring-biased latch member that is transversely repositionable relative to the saw blade to enable displacement of the latch member relative to the saw blade to enable pivoting of the saw blade interiorly of the housing.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U. S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved drywall utility knife which has all the advantages of the prior art utility knives and none of the disadvantages.

It is another object of the present invention to provide a new and improved drywall utility knife which may be easily and efficiently manufactured and marketed.

It is a further object of the present invention to provide a new and improved drywall utility knife which is of a durable and reliable construction.

An even further object of the present invention is to provide a new and improved drywall utility knife which is susceptible of a low cost of manufacture with regard to both materials and labor, and which accordingly is then susceptible of low prices of sale to the consuming public, thereby making such drywall utility knives economically available to the buying public.

Still yet another object of the present invention is to provide a new and improved drywall utility knife which provides in the apparatuses and methods of the prior art some of the advantages thereof, while simultaneously overcoming some of the disadvantages normally associated therewith.

Still another object of the present invention is to provide a new and improved drywall utility knife wherein the same sets forth a unique combination of various drywall implements utilized in the preparation and texturing of drywall edges to enable securement of such drywall pieces together in the formation of a wall surface in housing construction.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
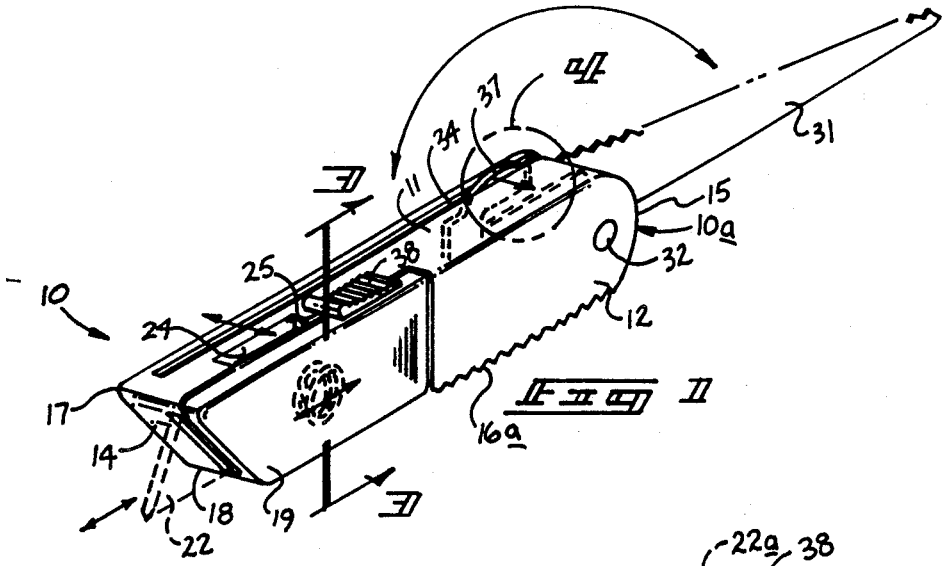
FIG. 1 is an isometric illustration of the instant invention.
Figure 2:
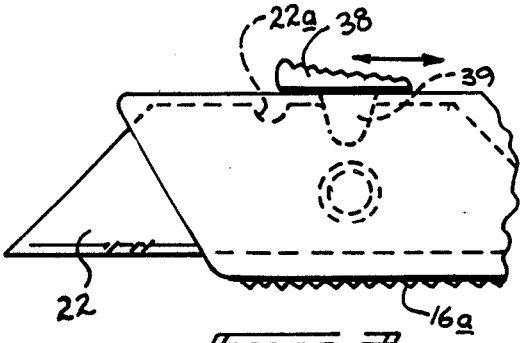
FIG. 2 is an orthographic view taken in elevation of the utility knife portion of the instant invention.
Figure 3:
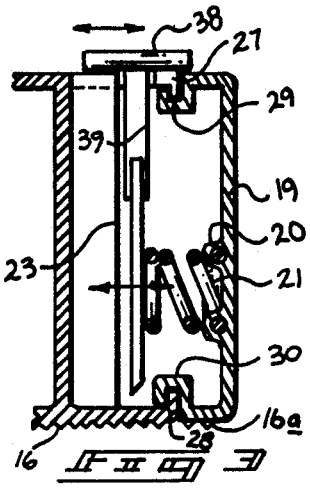
FIG. 3 is an orthographic view taken along the lines 3—3 of FIG. 1 in the direction indicated by the arrows.
Figure 5:
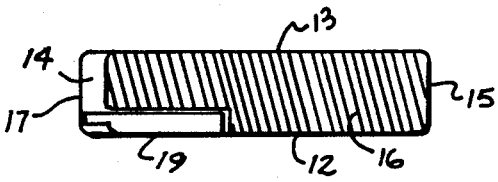
FIG. 5 is an orthographic bottom view of the instant invention.
Figure 4:
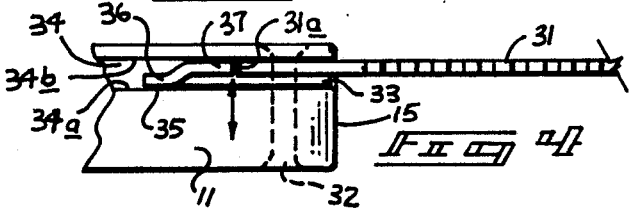
FIG. 4 is a top orthographic view of the section as set forth in FIG. 1.

With reference now to the drawings, and in particular to FIGS. 1 to 5 thereof, a new and improved drywall utility knife embodying the principles and concepts of the present invention and generally designated by the reference numeral 10 will be described.

More specifically, it will be noted that the drywall utility knife apparatus 10 essentially comprises a main elongate housing 10*a* including a top surface 11, a planar discontinuous right surface 12 formed with a downwardly stepped discontinuous right side of surface 12 slidingly receiving a knife housing 19 thereon. A left side 13 is spaced from the parallel to the right side 12 with a tapered forward side surface 14 including a top edge 17 at the intersection of the top surface 11 and the forward surface 14. The forward surface 14 tapers downwardly to a bottom rasp surface 16 formed with a rasp-like series of projections extending outwardly of the bottom surface to texture the edges of a segment of drywall or sheet rock once severed by the saw 31 or utility knife 22 of the instant invention. The rasp surface 16 includes a right side rasp surface 16*a* and companion rasp surface (not shown) on the left side 13 that extends about and around the edges of the bottom surface 16 to enable a depth engagement of the rasp surface with a segment of drywall. The rear surface of the housing 10*a* is formed with an arcuate rear side surface 15. The bottom surface 16 therefore of the housing is of a lesser extent than the top surface 11 whereupon an individual may secure the utility knife within a hand by anchoring the arcuate rear side surface 15 within the hand and grasping the tapering forward surface 14 by the fingers for a secure manual engagement of the tool when the saw 31 and utility blade 22 are nested within the housing 10*a*. The forward bottom edge 18 of the forward surface 14 does not receive the rasping surface therearound as the utility knife blade 22 is telescopingly mounted through the forward surface 14.

Slidingly mounted over the discontinuity of the right side 12 is a knife housing 19 of an extent substantially equal to that of the knife blade 22 and is formed with an interior wall surface 19*a* including a boss 20 integrally formed orthogonally to the interior wall surface 19*a* with a coil spring 21 fixedly secured to the boss 20 to impose upon a side surface of the knife blade 22 and maintain in a biased manner the knife blade 22 against an interior housing wall 23 coextensive with the knife housing 19 formed on an opposite side of the knife blade 22 to provide secure alignment of the knife blade 22 relative to the housing 19 and the interior wall 23. A "T" handle 38 extends above a bifurcated forward slot 24 formed to the top surface 11 of the housing 10*a* parallel to a first elongate slot 34 housing the saw blade 31 therewithin. The knife blade 22 is formed with a plurality of arcuate recesses 22*a* to receive a downwardly extending body 39 of the "T" handle 38 to enable manual reciprocation of the knife blade 22 relative to the housing 10*a*. A rear slot 25 extends rearwardly of the bifurcated forward slot 24 providing selective indexing of the knife blade 22 relative to the housing effecting a positioning of the knife blade 22 relative to the housing 10*a*. The interior housing wall 23 extends outwardly relative to the knife blade 22 and is provided with a downwardly extending upper flange 27 and an opposed upwardly extending lower flange 28 at opposite terminal ends of the interior wall 23 slidingly cooperating with the upper "U" shaped track 29 and a lower "U" shaped track 30 respectively formed on the knife housing 19 to frictionally receive and secure the knife housing 19 relative to the main housing 10*a*. The outer surface of the housing 19 is therefore in substantial alignment with the right side surface 12 when the knife housing 19 is received within the upper and lower flanges 27 and 28 respectively.

A saw blade 31 is pivotally mounted about a pivot pin 32 positioned adjacent the arcuate rear side surface 15 and pivotal relative to the elongate slot 34 from a first position receiving the saw blade 31 therewithin to a second position wherein the saw blade 31 is coextensive and aligned with the elongate slot 34 and the main housing 10*a*. The elongate slot 34 is substantially twice the width of the saw blade 33 wherein a saw blade shim 33 is spaced between the saw blade and an interior wall 34*a* of the elongate slot 34. The interior wall 34*a* is spaced parallel to an exterior wall 34*b* that is positioned adjacent the left side surface 13 of the main housing 10*a*. A lock member 35 of substantially the same thickness of the saw blade shim 33 is spaced interiorly of the elongate slot 34 wherein a forward end 36 of the lock member 35 is secured to the interior wall 34*a* wherein an outward end 37 of the lock member 35 is of a biased leaf spring construction formed with an upper end extending outwardly of the elongate slot 34 to enable manual deflection of the outward end and against the interior wall 34*a* of slot 34 to displace the outward end 37 from a rear blunt end of the saw blade 31 to enable interior pivoting of the saw blade 31 to a position within the main housing 10*a*. It is understood that as the lock member 35, and more particularly the outward end 37, is deflected adjacent the interior wall 34*a*, the outward end 37 continues to be biased outwardly of the interior wall 34*a* and therefore against a side surface of the saw blade 31 to frictionally secure the saw blade 31 in the retracted position within the main housing 10*a*, and more particularly within the elongate slot 34.

As to the manner of usage and operation of the instant invention therefore the same should be apparent from the above description, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A drywall utility knife comprising, in combination, a main elongate housing including a left side surface spaced from a discontinuous right side surface wherein said right side surface includes an inwardly stepped recess surface, and a top surface overlying and spaced from a bottom surface, a forward surface, and an arcuate rear surface, and said top surface including a first elongate slot spaced from said forward surface and extending into said arcuate rear surface, and a serrated drywall saw pivotally mounted adjacent a forward surface and pivotal from a first position interiorly of said housing to a second position exterior of said housing aligned with said housing wherein said position, and a lock member positioned within said first elongate slot adjacent a rear blunt surface of said saw to lock said saw in said second position, and a trapezoidal utility knife telescopingly mounted through said forward surface, and a drywall texturing means formed on said bottom surface to texture a drywall portion when severed by said saw or said utility knife.

2. A drywall utility knife as set forth in claim 1 wherein said first elongate slot includes an interior wall spaced from and parallel to an exterior wall, and said lock member includes a forward end integrally secured to said interior wall, and an outward end resiliently formed to said forward end biased outwardly of said interior wall to engage said blunt surface when said saw is said second position.

3. A drywall utility knife as set forth in claim 2 wherein said saw includes a pivot pin extending orthogonally through said saw and through said right side surface and said left side surface to pivotally mount said saw, and a saw blade shim mounted between said interior wall of said elongate slot and said saw to position said saw adjacent said exterior of said elongate slot, and said lock member is of a thickness substantially equal to a thickness defined by said saw blade shim.

4. A drywall utility knife as set forth in claim 3 wherein the outward end of the lock member extends a distance above the top surface to enable manual displacement of the outward end of the lock member relative to the blunt surface of said saw.

5. A drywall utility knife as set forth in claim 4 wherein the utility knife includes a knife housing slidably mounted overlying said stepped surface of said right side surface.

6. A drywall utility knife as set forth in claim 5 wherein said stepped surface includes an upper downwardly extending flange, and a lower upwardly extending flange to slidingly receive an upper "U" shaped channel and a lower "U" shaped channel integrally formed to the knife housing.

7. A drywall utility knife as set forth in claim 6 wherein the knife housing includes a boss member integrally formed to an interior surface of the knife housing and a spring member integrally secured to said boss member extending toward the stepped surface of the right side surface to resiliently capture the utility knife therebetween.

8. A drywall utility knife as set forth in claim 7 wherein the texturing means comprises a rasp surface including upwardly extending projections to enable abrading of the drywall portion when severed by the saw or the utility knife.

9. A drywall utility knife a set forth in claim 8 wherein the rasp surface extends about elongate edges of the main housing to provide a rasp surface upon a lowermost surface portion of the right side surface and the left side surface respectively.

10. A drywall utility knife as set forth in claim 9 wherein the top surface is of a greater lineal extent than the bottom surface wherein the forward surface tapers downwardly from the top surface to the bottom surface.

* * * * *